United States Patent [19]

Glesser

[11] Patent Number: 4,640,058

[45] Date of Patent: Feb. 3, 1987

[54] PORTABLE BLADE SHARPENER

[76] Inventor: Louis S. Glesser, P.O. Box 800, Golden, Colo. 80401

[21] Appl. No.: 781,722

[22] Filed: Sep. 30, 1985

[51] Int. Cl.[4] ..... B24B 3/54

[52] U.S. Cl. ..... 51/211 R; 51/204; 76/82.2; 76/86

[58] Field of Search ..... 51/204, 205, 211 R, 51/212, 214, 354; 76/82, 82.2, 86, 88

[56] References Cited

U.S. PATENT DOCUMENTS

| | | | |
|---|---|---|---|
| 1,038,484 | 9/1912 | Boye | 76/86 |
| 1,894,579 | 1/1933 | Blankner | 51/354 |
| 2,098,530 | 11/1937 | Battocchi | 51/214 |
| 2,674,072 | 4/1954 | Lohmann | 51/211 R |
| 3,894,362 | 7/1975 | Graves | 51/211 R |
| 4,231,194 | 11/1980 | Glesser | 51/211 R |
| 4,259,815 | 4/1981 | Kuban | 51/211 R |

FOREIGN PATENT DOCUMENTS

| | | | |
|---|---|---|---|
| 0002603 | of 1867 | United Kingdom | 51/214 |
| 0027484 | of 1911 | United Kingdom | 76/86 |

*Primary Examiner*—Frederick R. Schmidt

*Assistant Examiner*—Robert A. Rose

*Attorney, Agent, or Firm*—Roger A. Marrs

[57] ABSTRACT

Apparatus for sharpening cutting edges of a blade is disclosed herein which is foldable between an operative position and a storage position that includes a base having pivoted support sections carrying elongated sharpening elements providing opposing surfaces against which one side of the blade to be sharpened may be drawn when the elements are in their operative position. A handle member pivotally attaches at one end to the free end of one of the elements while a pair of spaced projections are incorporated therein for selectively receiving the free end of the other element wherein the elements are in the operative position. The handle member further includes an elbow portion for releasably receiving the end of the last mentioned element when positioned immediately adjacent the first mentioned element when the elements are in the storage position. A hand grip portion is provided on the end of the handle member which includes a releasable retainer for coupling the handle member to the base sections when the elements are in the storage position.

1 Claim, 5 Drawing Figures

30
31
32
33
34
35
36
37
38
40
41
42
44
46
48
50
10
11
12
13
14
15
16
17
18
20
21
22
23
24
25
26
2
3
4

PORTABLE BLADE SHARPENER

BACKGROUND OF THE INVENTION

1. Field of the Invention

The present invention relates to apparatus for sharpening cutting edges of a blade and more particularly to a novel portable blade sharpener having a pair of sharpening elements adapted to be folded from an operative position into a storage position so that the apparatus may be readily transported from place to place or placed in a storage location.

2. Brief Description of the Prior Art

A variety of prior blade sharpeners have been employed in the past for sharpening the cutting edges of blades and such prior devices are shown and disclosed in U.S. Pat. No. 3,894,362 and more recently in U.S. Pat. No. 4,231, 194. Although these devices are useful in the sharpening of cutting edges, difficulaties and problems have been encountered which stem largely from the fact that the sharpening elements and the base for supporting them are separate and require assemblage and disassemblage for use and storage. Also, when in the storage condition, the diassembled parts require a separate package such as a plastic envelope or the like which keeps all of the elements in a convenient location.

Also, difficulties have been encountered from a safety point of view inasmuch as the user's hand must be placed on a base which is close to and beneath or lower than the sharpening area in which the blade is being drawn for sharpening purposes. In many instances, the user will draw the blade across the sharpening element and when the tip of the blade terminates contact therewith, the downward pressure of the user's hand causes the cutting edge to urge the blade into contact with the hand of the user supporting the base. Obviously, this is a dangerous and undesirable situation. In the instance of the last mentioned patent, a metal rod has been incorporated into the base which serves to prevent the blade from coming into contact with the user's hand supporting the base. However, this does require an additional element in the assemblage and requires that the user properly install the rod in place prior to use.

Therefore, a long standing need has existed to provide a novel blade sharpener which is foldable between an operative and a stored position whereby the device is portable, self-contained and does not require assembly for use or disassembly for storage. Also, such a novel blade sharpening apparatus should provide for safety by eliminating the need for supporting the device from its under side during a sharpening procedure so that the user's hands are never below the cutting edge of the blade being sharpened.

SUMMARY OF THE INVENTION

Accordingly, the above problems and difficulties are obviated by the present invention which provides a novel blade sharpening apparatus including a base supporting a pair of sharpening elements pivotally connected to each other at adjacent ends and further incorporating a handle means pivotally attached to the free end of one of the sharpening elements and incorporating detachable means for selectively engaging with the free end of the other sharpening element whereby the sharpening elements and handle member are readily disposed between an operable position and a storage position such that the sharpening elements are adjacent one another in the stowed position and separated from one another at the opposite end in the operative position whereby the handle member or means serves as a retainer for holding the respective sharpening elements in either the operative or storage position.

Therefore, it is among the primary objects of the present invention to provide a novel sharpening device for the cutting edge of a blade which is portable and may be readily folded and unfolded between a storage and operative position without disassembly of any components forming the apparatus or device.

Another object of the present invention is to provide a novel blade sharpener which may be readily folded into a compact arrangement that may be readily carried as personal equipment by a traveler or camper or the like and which may be readily unfolded into a position for sharpening a blade of a knife or the like with safety for the user.

Yet another object of the present invention is to provide a novel blade sharpener having portable characteristics which includes a retaining means operable to maintain the sharpening elements of the device in either its operative or storage positions.

Still another object of the present invention is to provide a novel blade sharpener which permits the user to maintain his hand or hands above the cutting edge of the knife during the performance of a sharpening procedure so that the procedure may be performed in complete safety.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figures 1, 2, 3, 4, 5:
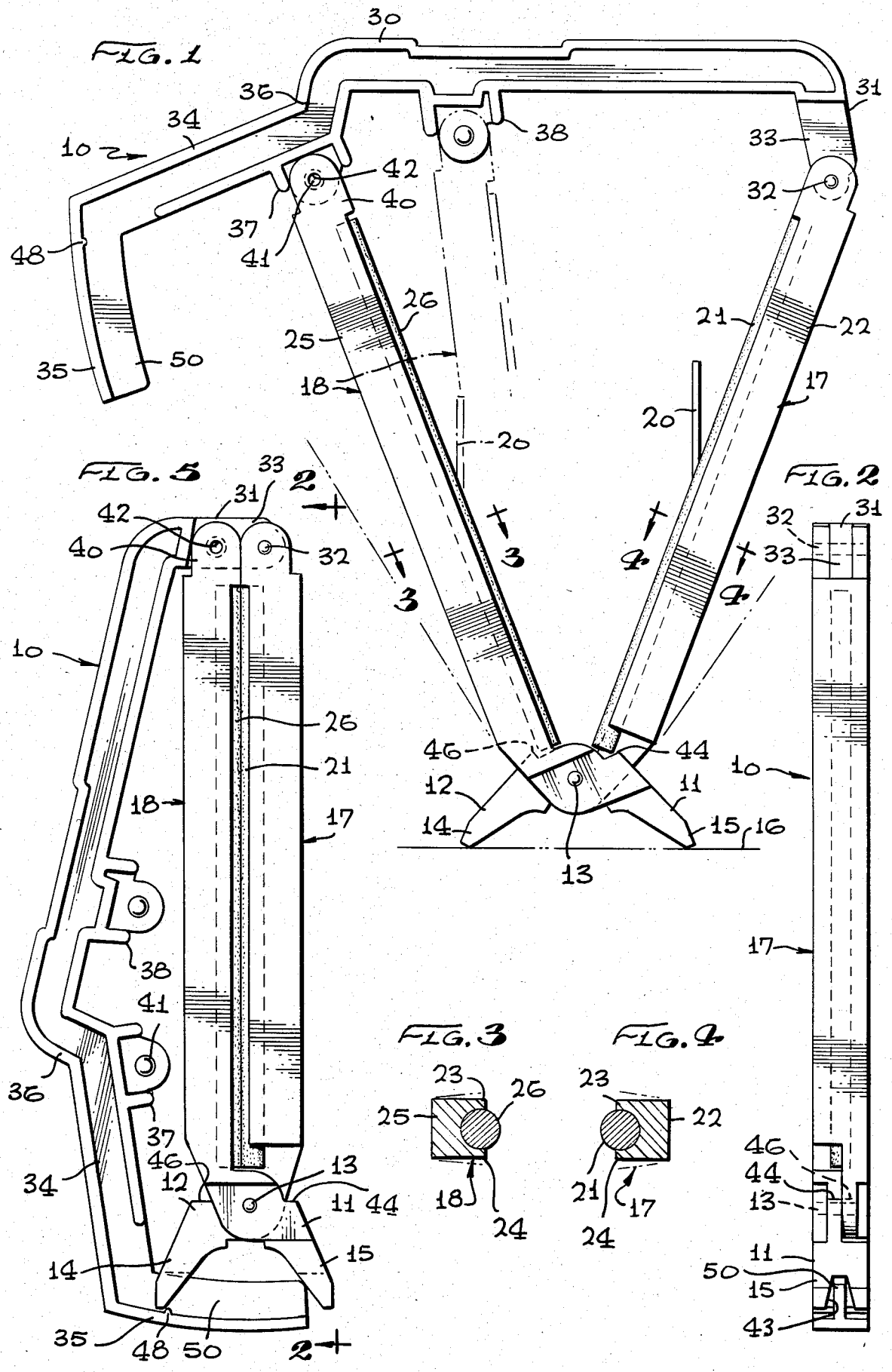
FIG. 1 is a side elevational view of the novel blade sharpener of the present invention illustrated in its operative position.
FIG. 2 is an end elevational view of the blade sharpener shown in FIG. 5 as taken in the direction of arrows 2—2 thereof.
FIG. 3 is a transverse cross-sectional view of a cutting element used in the apparatus of FIG. 1 as taken in the direction of arrows 3—3 thereof.
FIG. 4 is a transverse cross-sectional view of the sharpening element used in the embodiment of FIG. 1 as taken in the direction of arrows 4-4 thereof.
FIG. 5 is a side elevational view of the blade sharpening apparatus illustrated in its folded position for storage purposes.

Referring to FIG. 1, the novel portable blade sharpener incorporating the present invention is illustrated in the general direction of arrow 10 which includes a base having base portion 11 and base portion 12 coupled together at adjacent ends by means of a pivot 13. The base sections 11 and 12 include bifurcated feet 14 and 15 which are placed upon a supporting surface 16 when the device is in an operative position preparatory and during use.

Each of the base sections 11 and 12 includes an upwardly projecting elongated support elements 22 and 25 which are of a square configuration in cross-section incorporating a groove on a selected side of the element for releasably retaining a honing stone or element. One side of a blade intended to be sharpened may be drawn against the exposed honing stone. In general, numeral 17 represents one support and blade sharpening assembly and numeral 18 identifies the other support and blade sharpening assembly while numeral 20 indicates the knife blade intended to be sharpened and numerals 21 and 26 represent the retained honing stones.

A feature of the present invention resides in the provision for manually installing or press fitting the honing stones 21 and 26 into grooves of the supports 22 and 25. The assembly is more clearly shown in FIGS. 3 and 4 wherein it can be seen that the honing stones or members are of circular cross-section and are pressed between a pair of slide rails 23 and 24 which define the groove for receiving the respective stones. By this arrangement, the stones or members 21 and 26 are snap-locked into position having extra portions exposed into a central sharpening area for receiving the cutting edge of blade 20. Should the porous surface of the stones become clogged with metal particles or the like, the stones can be popped out from the supports 22 and 25 and cleaned or turned for reinsertion so as to expose another portion for use in the sharpening procedure. It is to be noticed that sharpening assembly 18 comprises a similar support 25 which insertably receives and holds the honing member 26 taking the form of a rod as shown in FIG. 4. Both of the honing members 21 and 26 are retained within the respective supports inasmuch as the slot or groove provided therein incorporates a reduced opening so that the respective honing member can be forced through the slightly reduced and flexible opening leading into the groove of the supports.

FIG. 1 also portrays a handle means which comprises an elongated member 30 having an elbow portion 31 formed at one end of the member which terminates with a pivot connection 32 with the end of support 22 opposite from its end carried on base portion 11. The elbow portion 31 includes a central web which is of reduced thickness and is indicated by numeral 33. The opposite end of member 30 from its end formed with elbow 31, integrally includes a hand grip portion 34 that outwardly extends from the sharpening assemblies 17 and 18 to terminate in a retaining flange or projection 35 having a detent 48 and a web 50.

The handle member 30 further includes a shoulder portion 36 which joins the hand grip 34 to the major length of the member 30 and further incorporates a pair of spaced apart projections indentified respectively by numerals 37 and 38. Each of the projections 37 and 38 may be selectively placed between the elements of a yoke carried at the extreme end of the support 25 associated with sharpening assembly 18. Therefore, when the handle means or member is pivoted about pivot 32, either one of the projections may be introduced into the space between the legs of the yoke, broadly identified by numeral 40 carried on the support 25. A detent 41 is carried on the projections, such as projection 37, which selectively and yieldably engages with a hole, such as hole 42, for retention purposes.

By providing the pair of projections 37 and 38, a choice between two angles of displacement for the honing elements 21 and 26 is offered to the user with respect to a vertical plane. As illustrated in solid lines, an angle of 22 degrees is provided which is the normal or conventional angle employed when sharpening knife blades. However, in such instances when other cutting edges require different angles, such as 15 degrees for example, the support 25 may be positioned into engagement with the projection 38.

As shown in FIG. 1, the blade sharpening apparatus 10 is in its operative position wherein the sharpening assemblies 17 and 18 are pivoted outwardly at their ends farthest from base portions 11 and 12 so that a sharpening area is defined between the opposing surfaces of the honing assemblies or members 21 and 26. The blade 20 shown in solid lines is drawn across the surface of the honing member 21 while the blade 20 shown in broken lines is illustrated as being drawn across the honing member 26. In use, the knife blade having a cutting edge is situated so that the blade is in a perpendicular relationship to the longitudinal axis of the base and so that its cutting edge is initially in contact with an upper portion or elevation of one of the abrasive sharpening or honing members. Maintaining this perpendicular relationship with respect to the base, the blade is drawn down into the sharpening member and the knife is moved longitudinally at the same time so that the point of contact moves down the respective honing member and from adjacent the blade to adjacent the tip of the knife. This action is repeated on the other side of the knife blade being initially put into contact with the left side of the sharpening element and the longitudinal movement of the knife blade again accompanies the downward cutting action of the blade against the abrasive element. This action is repeated on the left and the right side of the knife blade until the blade is sharpened. The procedure is successful in sharpening both serrated and straight edge cutting blades. If desired, the blade may be drawn against cutting element or member 21 in one direction and then the device can be reversed and the blade again drawn across the abrasive member 21 so that the other side of the knife cutting edge is honed. Since the apparatus is light in weight, preferably being composed of plastic or plastic-like material, it is easy for the user to move or carry the device from one place to another for use.

Also, it is to be noted that during use, the user's hand is grasped about the grip 34 and a downward pressure is exerted so that the member 30, supports elements 22 and 25 form a closed frame through which applied loads are transferred into the base sections 11 and 12. It is to be particularly noted that when drawing of the blade through the sharpening area and when in contact with either of the honing elements or members, the cutting edge of the blade is away from the hand of the user engaging with the grip 34. Therefore, should the blade inadvertently slip, no danger is encountered with the cutting edge coming into contact with user's hand since the user's hand is above the knife blade.

Referring now in detail to FIG. 5, it can be seen that the apparatus of FIG. 1 is folded from its operative position into a storage position wherein the support member 25 is pivoted about pivot 13 so that the honing members 21 and 26 are in close and substantially parallel relationship. The handle member 30 has been pivoted about pivot 32 so that the web 33 of reduced diameter fits within the yoke 40 provided in the the free end of support 25. The handle projection 35 retains the support members or assemblies in this position by placing the web 50 within the bifurcation 43 on the underside of the base sections or portions 11 or 12 and snap engagement of the detent 50 with a foot of base 14. Such a groove or bifurcation for receiving the thickness of the handle portion 35 is indicated by numeral 43 in FIG. 2. In this folded position, the blade sharpening device 10 is readily transportable and may be stored in a camper's pack in a special pouch carried on the belt or in a convenient pouch in a tool box.

A feature resides in the structure and manner of removing the honing stones from retention by the side rails 23 and 24. When the support member 25 is pivoted about pivot connection 13 counterclockwise so that the yoke 40 passes or goes beyond projection 37, a shoulder 44 carried on the base member 11 engages with the lower end of the honing stone 21 and forceably urges the stone out of its respective groove. Stone 26 is removed by rotating support member 22 clockwise so that shoulder 46 engages the bottom or lower end of the stone 26. The outer broken lines in FIG. 1 show the approximate limits of support member rotation to effect honing stone removal.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A blade sharpening apparatus comprising:

a base;

a pair of elongated sharpening elements carried on said base pivotally connected to each other at adjacent ends and free at their opposite ends;

an elongated handle means having one end pivotally attached to said free end of a selected one of said sharpening elements and having a second free end;

detachable means on said handle means between said ends thereof cooperating between said handle means and the free end of said other sharpening element for releasable securement therebetween whereby said sharpening elements are disposed between an operable position and a storage position such that said sharpening elements are adjacent to one another in said storage position and separated in a V-shaped configuration in said operable position;

said handle means and said releasable securement means define a detachable retainer;

said base having a pair of legs for supporting the apparatus when in said operable position, each leg integral with and extending from a respective sharpening element, said legs joined together by a pivot constituting said pivotal connection said second free end of said handle means having a releasable securing means cooperating with at least one of said legs to secure said sharpening elements adjacent each other when in said storage position.

* * * * *